US006167882B1

(12) United States Patent
Almqvist et al.

(10) Patent No.: US 6,167,882 B1
(45) Date of Patent: Jan. 2, 2001

(54) DELIVERY CONDUIT FOR A BREATHING EQUIPMENT

(75) Inventors: Hans Almqvist, Branford, CT (US); Staffan Ekström, Lidingö (SE)

(73) Assignee: Interspiro Europe AB, Lidingo (SE)

( * ) Notice: Under 35 U.S.C. 154(b), the term of this patent shall be extended for 0 days.

(21) Appl. No.: 09/101,636

(22) PCT Filed: Feb. 21, 1997

(86) PCT No.: PCT/SE97/00295

§ 371 Date: Jul. 14, 1998

§ 102(e) Date: Jul. 14, 1998

(87) PCT Pub. No.: WO97/30753

PCT Pub. Date: Aug. 28, 1997

(30) Foreign Application Priority Data

Feb. 23, 1996 (SE) ..... 9600688

(51) Int. Cl.[7] ..... B63C 11/02

(52) U.S. Cl. ..... 128/201.27; 128/201.28

(58) Field of Search ..... 128/204.26, 201.24, 128/201.25, 201.27, 203.12, 206.12, 206.15, 202.11, 201.15, 911, 912, 201.28

(56) References Cited

U.S. PATENT DOCUMENTS

| | | | | |
|---|---|---|---|---|
| 2,999,497 | | 12/1961 | Hamilton et al. | 128/142 |
| 3,224,444 | * | 12/1965 | Dempster | 128/204.26 |
| 3,935,861 | * | 2/1976 | Warncke | 128/204.26 |
| 4,404,969 | * | 9/1983 | Cresswell et al. | 128/201.23 |
| 4,449,524 | * | 5/1984 | Gray | 128/204.26 |
| 4,463,755 | | 8/1984 | Suzuki | 128/204.18 |
| 4,534,344 | * | 8/1985 | Constance-Hughes | 128/201.15 |
| 5,720,279 | * | 2/1998 | Furuichi et al. | 128/204.26 |

* cited by examiner

*Primary Examiner*—Aaron J. Lewis
*Assistant Examiner*—Teena Mitchell
(74) *Attorney, Agent, or Firm*—Pollock, Vande Sande & Amernick

(57) ABSTRACT

Breathing equipment for use in toxic atmospheres or beneath water including a breathing mask, a pressure regulator adjacent the source of breathing gas, and a source of breathing gas. A conduit transports breathing gas from the source of breathing gas to the mask. The conduit includes an inner conduit that functions to transport breathing gas to the breathing mask from the pressure regulator, and an outer conduit that surrounds the inner conduit and that protects the inner conduit and defines therewith a passageway that is sealed against the surroundings. The inner conduit is connected to the breathing mask so as to deliver thereto breathing gas that leaks from the inner conduit and does not normally transport breathing gas therethrough. A pressure regulating valve connects the inner conduit to the breathing mask and delivers breathing gas to the breathing mask at an overpressure.

15 Claims, 1 Drawing Sheet

DELIVERY CONDUIT FOR A BREATHING EQUIPMENT

FIELD OF THE INVENTION

The present invention relates to breathing equipment for use in toxic atmospheres or under water, comprising a face mask or the like, a breathing gas source, and conduit means for transporting gas from source to mask.

BACKGROUND OF THE INVENTION

Breathing equipment of this kind is used, for instance, by firemen, persons who are required to occupy toxic environments, and divers. It is therefore of utmost importance to minimize the risk of serious damage to the equipment and provide equipment that is extremely reliable in operation.

The breathing gas is normally carried in bottles or flasks on the back of the person using the equipment, wherein gas is led to the mask through a hose-like conduit. This conduit is vulnerable to external damage. Because the conduit is the only means of transporting gas between bottle and mask, the escape of gas through small leakage sites along its length may also have serious consequences.

SUMMARY OF THE INVENTION

One object of the present invention is to provide a gas conduit between a gas source and a mask that is protected against external influences and with which the risks of leakages in the conduit are reduced.

Another object is to increase the safety of the breathing equipment still further, by enabling gas to be delivered to the mask even in the event of a fault in the regulating mechanism or valve mechanisms between a gas bottle and a mask.

The invention is based on the understanding that these objects can be achieved by using between a gas source and a breathing mask a double hose-conduit which will give further protection to the standard gas conduit and enable any gas that leaks therefrom to be transported to the mask, and also to enable breathing gas to be delivered from a bottle to a mask while by-passing faulty regulating and valve components.

Accordingly, breathing equipment according to the present invention is characterized in that the conduit means includes an inner conduit which functions to transport gas to the mask from a pressure regulator mounted adjacent the source, and an outer conduit which surrounds the conduit first mentioned so as to protect the inner conduit and form a passageway that is sealed against the surroundings and the inner conduit and which is connected to the mask so as to deliver thereto any gas that may leak from the inner conduit.

A conduit means of this kind reduces the risk of damage to the inner gas conduit and minimizes the effects of gas leakages therefrom.

The passageway is preferably connected to the mask through the medium of a biased check valve which functions to maintain a given overpressure in the passageway, so as to prevent gas from being sucked into the passageway from the surroundings and transported to the mask should the outer conduit become damaged.

The passageway may be connected directly to the space in the mask. Alternatively, the passageway may be connected to the mask by means of the same breathing valve as that to which the inner gas conduit is connected, or to a separate breathing valve, wherein the passageway may serve as a second gas supply channel.

The other end of the passageway may be connected to the gas source either upstream or downstream of a pressure regulator connected thereto. So that gas will be delivered to the mask through this passageway even if the pressure regulator, for instance, were to malfunction, it is preferred to connect the passageway to the gas bottle upstream of the standard bottle valve. This enables the gas flow to the pressure regulator to be switched-off while still allowing gas to be delivered to the mask via the passageway defined between the outer hose and the inner hose.

BRIEF DESCRIPTION OF THE DRAWINGS

The invention will now be described in more detail with reference to exemplifying embodiments thereof and also with reference to the accompanying drawings.

DETAILED DESCRIPTION OF THE INVENTION

Figure 1:
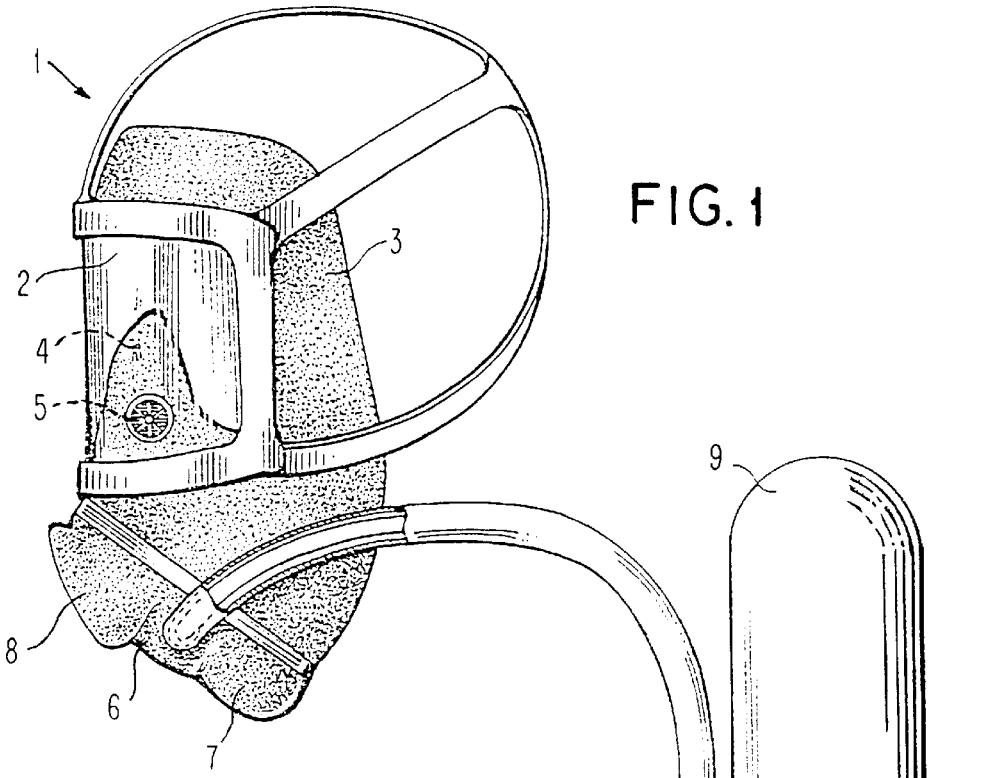
FIG. 1 illustrates schematically breathing equipment according to one embodiment of the present invention.

Shown in FIG. 1 is a breathing mask 1 that includes a viewing visor 2. The breathing mask includes an outer mask 3 which seals around the wearer's face, and an inner mask 4 which seals over the wearer's nose and mouth. Also included is a check valve 5 through which gas delivered to the outer mask and over the visor, to keep the visor clear, is sucked into the inner mask.

The aforedescribed mask is of conventional design and includes typically a breathing valve 6 which regulates the amount of inhalation gas, and an exhalation valve 7. Reference numeral 8 identifies a diaphragm speech cone.

The components 6–8 may be of a conventional kind and will not be described in more detail in this document.

Reference numeral 9 identifies a gas bottle which contains breathing gas that is pressurized to a pressure of about 300 bars and which is normally carried upside down on the wearer's back. Reference numeral 10 identifies a knob or wheel that coacts with a bottle valve 20. The valve functioning to open and close a gas conduit 11 connected to a pressure regulator 12. The pressure regulator may be of conventional design and includes a spring-biased plunger 13 and a valve body 14. The pressure of the gas flow leaving the pressure regulator is normally set to about 7 bars. Breathing gas is delivered to the mask 1 at this pressure through a gas conduit 15 which is connected to the pressure regulator and which conducts breathing gas to the breathing valve 6 connected to the mask.

In accordance with the invention, the gas conduit 15 is surrounded by an outer conduit 16 which protects the inner conduit 15 against mechanical damage or damage by fire and/or heat. The outer conduit 16 and the inner conduit 15 define therebetween a passageway 17 which is sealed against the surroundings and one end of which is connected to the breathing mask 1, either through the medium of the breathing valve 6 or through the medium of a separate breathing valve. Alternatively, the passageway 17 may by-pass the breathing valve and be connected directly to the space in the mask.

Although not shown, that end of the passageway 17 which is connected to the mask 1 is conveniently provided with a check valve that prevents ambient atmosphere from being sucked into the passageway in the event of damage to the outer conduit 16. The check valve may be set to maintain in the passageway 17 an overpressure of up to about 1 m water column.

One function of the passageway 17 is that any air that may leak from the inner hose or conduit 15 will collect in the passageway and be conducted thereby to the breathing mask, meaning that the wearer will be supplied with necessary breathing gas even should the inner conduit leak. When the outer conduit is solely intended to provide this facility, the other end of the conduit may be closed to provide a "blind" conduit.

However, in the case of the embodiment illustrated in FIG. 1, the passageway 17 is connected to the gas bottle 9 upstream of a bottle valve 20, through the medium of a connecting conduit 18. The gas flow and pressure in the connecting conduit 18 and the passageway 17 are set with the aid of throttle means that can be adjusted by means of a knob 19. Throttling of the gas flow and pressure does not affect the flow of gas to the bottle valve 20.

Should the pressure regulator 12 malfunction, the bottle valve 20 can therewith be closed and the throttle 19 opened such that gas will be delivered from the bottle 9 directly to the passageway 17, which conducts this gas to the mask 1. This ensures that gas will be delivered to the mask even in the case of a faulty pressure regulator. When the passageway 17 is connected to the mask while by-passing the breathing valve 6, gas can be delivered to the mask 1 via the passageway even when the breathing valve is faulty.

It is also possible to provide constantly a small flow of gas through the passageway 17, this gas flow being delivered directly into the mask for instance, so as to enhance wearer comfort among other things.

Figure 2:
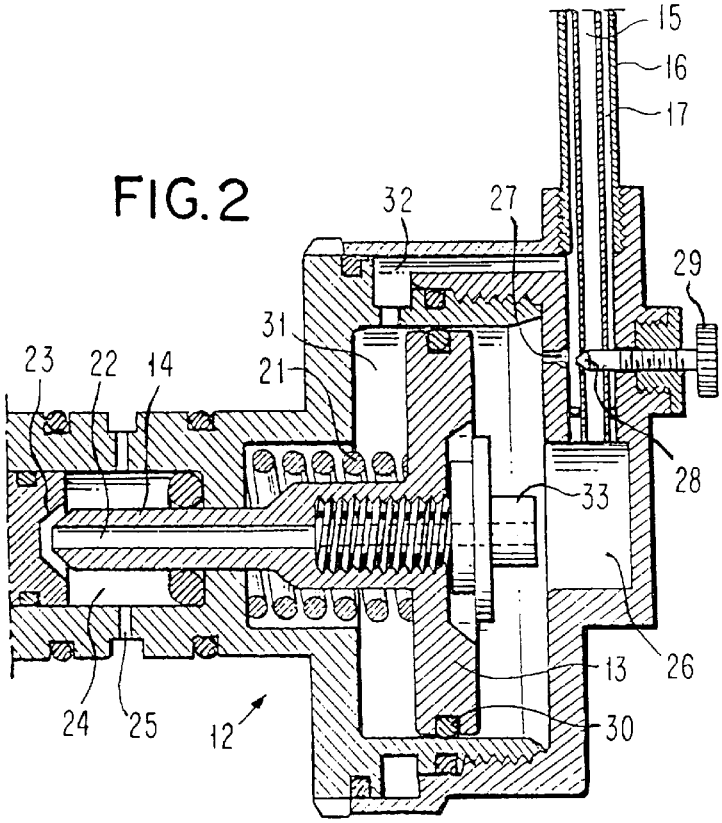
FIG. 2 illustrates schematically an alternative connection of the gas hose to the pressure regulator in the equipment shown in FIG. 1.

FIG. 2 illustrates an alternative means of connecting the double conduit 15, 16 to a pressure regulator 12 of a gas bottle (not shown). As in the earlier case, the pressure regulator includes a plunger 13 which is biased by a spring 21 and which includes a valve body 14 provided with a central passage 22. The end of the valve body is adapted for coaction with a valve seat 23.

The pressure regulator 12 is connected to the gas bottle so that gas under high pressure is delivered to a valve chamber 24 through holes 25. When the valve is held open by the spring 21, high pressure gas will pass from the valve chamber 24 into the passage 22 in the valve body 14 and up into a chamber 26 on the opposite side of the plunger 13. Reference numeral 33 identifies a sound damping device.

In this way, there is built-up in the chamber 26 a gas pressure which acts on the plunger 13 and closes the valve against the pressure of the spring 21. In this regard, the spring force may be set so that the valve will be reopened when the chamber pressure is 7 bars for instance. This results in a regulated pressure of about 7 bars in the chamber 26, to which the inner gas conduit 15 is directly connected. Breathing gas will therewith be conducted to the breathing mask at this pressure.

The reference numeral 27 identifies a passage that can be throttled by means of a valve 28 which is regulated by means of a knob 29. Breathing gas can be delivered through the passage 27 to the passageway 17 defined between the inner conduit 15 and the outer conduit 16. Thus, when the passage 27 by-passes the breathing valve on the mask, gas can be delivered directly to the breathing mask 1 via said passage. As with the embodiment illustrated in FIG. 1, this ensures that gas will be delivered to the wearer even should the breathing valve malfunction.

However, as mentioned above, the passageway 17 may be connected either to the breathing valve or to a separate breathing valve, therewith enabling this passageway to be used as a second or redundant breathing-gas delivery channel and therewith provide greater safety by redundancy.

The aforedescribed function of the passageway 17 in the above examples of transporting breathing gas between source and mask while by-passing desired regulating and valve mechanism on the gas source and/or the mask can also be achieved with the aid of an additional conduit or hose that extends parallel although not coaxially with the main gas conduit.

In the case of a pressure regulator of the aforesaid kind it is difficult to prevent in the long run some leakage of breathing gas past the O-ring 30 of the plunger 13 and into the rearwardly lying chamber 31.

This problem has earlier been resolved by providing the chamber 31 with a ventilating channel that is open to the surroundings and that is closed with the aid of a rubber lip or like device. However, it is difficult to maintain effective sealing with the aid of such a rubber lip, particularly after having cleaned the equipment several times. Defective sealing will enable liquid and dirt particles to penetrate into the pressure regulator. Neither can this solution be applied with diving equipment.

This problem has been solved in accordance with the invention by providing the chamber 31 with a ventilation channel 32 which communicates with the passageway 17 defined between the inner conduit 15 and the outer conduit 16. This avoids the problem associated with rubber seals while, at the same time, enabling the leaking gas to be used by the wearer.

Although the invention has been described above with reference to a number of preferred embodiments thereof it will be understood that several modifications can be made within the scope of the following claims. Such modifications include the connection of the outer conduit of the double conduit arrangement to the gas source and to the breathing mask respectively. The type of valves and regulators used and their design can also be chosen as desired.

What is claimed is:

1. Breathing equipment for use in toxic atmospheres or beneath water, comprising:

a breathing mask;

a pressure regulator adjacent the source of breathing gas;

a source of breathing gas;

conduit means for transporting breathing gas from the source of breathing gas to the mask, the conduit means including an inner conduit that functions to transport breathing gas to the breathing mask from the pressure regulator, and an outer conduit that surrounds the inner conduit and that protects the inner conduit and defines therewith a passageway that is sealed against the surroundings, wherein the outer conduit is connected to the breathing mask so as to deliver thereto breathing gas that leaks from the inner conduit and not normally transporting breathing gas therethrough; and a pressure regulating valve for connecting the inner conduit to the breathing mask and delivering breathing gas to the breathing mask at an overpressure with respect to the mask.

2. The breathing equipment according to claim 1, further comprising:

a biased check valve for connecting the passageway to the breathing mask, the check valve functioning to maintain a given overpressure in the passageway.

3. The breathing equipment according to claim 1, further comprising:

a breathing valve for connecting the inner conduit to the breathing mask, whereas the passageway is connected directly to the breathing mask while bypassing the breathing valve.

4. The breathing equipment according to claim 1, further comprising:

a separate breathing valve for connecting the passageway to the mask, therewith enabling the passageway to function as a secondary breathing gas delivery conduit.

5. The breathing equipment according to claim 1, further comprising:

a breathing valve for connecting the passageway and the inner conduit, therewith enabling the passageway to function as a secondary breathing gas delivery conduit.

6. The breathing equipment according to claim 1, wherein an end of the passageway distal from the breathing mask is connected to the breathing gas source at a point downstream of the pressure regulator.

7. The breathing equipment according to claim 6, wherein an end of the passageway coacts with an adjustable throttle means.

8. The breathing equipment according to claim 1, wherein an end of the passageway that lies distal from the breathing mask is connected to the breathing gas source at a point upstream of the pressure regulator.

9. The breathing equipment according to claim 8, wherein the source of breathing gas comprises a gas bottle including bottle valve located upstream of the pressure regulator, wherein an end of the passageway is connected to the breathing gas source at a point upstream of the bottle valve.

10. The breathing equipment according to claim 1, wherein the pressure regulator includes a spring-biased plunger, and a space defined by the breathing mask is ventilated to the passageway on a side of the spring-biased plunger that lies opposite to a side that the inner conduit is connected to.

11. Breathing equipment for use in toxic atmospheres or beneath water, comprising:

a breathing mask;

a pressure regulator adjacent the source of breathing gas;

a source of breathing gas;

conduit means for transporting breathing gas from the source of breathing gas to the mask, the conduit means including an inner conduit that functions to transport breathing gas to the breathing mask from the pressure regulator, and an outer conduit that surrounds the inner conduit and that protects the inner conduit and defines therewith a passageway that is sealed against the surroundings and that is connected to the breathing mask so as to deliver thereto breathing gas that leaks from the inner conduit; and a breathing valve for connecting the inner conduit to the breathing mask, whereas the passageway is connected directly to the breathing mask while bypassing the breathing valves.

12. Breathing equipment for use in toxic atmospheres or beneath water, comprising:

a breathing mask;

a pressure regulator adjacent the source of breathing gas;

a source of breathing gas; and conduit means for transporting breathing gas from the source of breathing gas to the mask, the conduit means including an inner conduit that functions to transport breathing gas to the breathing mask from the pressure regulator, and an outer conduit that surrounds the inner conduit and that protects the inner conduit and defines therewith a passageway that is sealed against the surroundings and that is connected to the breathing mask so as to deliver thereto breathing gas that leaks from the inner conduit, wherein an end of the passageway that lies distal from the breathing mask is connected to the breathing gas source at a point upstream of the pressure regulators.

13. The breathing equipment according to claim 12, wherein the source of breathing gas comprises a gas bottle including a bottle valve located upstream of the pressure regulator, wherein an end of the passageway is connected to the breathing gas source at a point upstream of the bottle valve.

14. Breathing equipment for use in toxic atmospheres or beneath water, comprising:

a breathing mask;

a pressure regulator adjacent the source of breathing gas;

a source of breathing gas;

conduit means for transporting breathing gas from the source of breathing gas to the mask, the conduit means including an inner conduit that functions to transport breathing gas to the breathing mask from the pressure regulator, and an outer conduit that surrounds the inner conduit and that protects the inner conduit and defines therewith a passageway that is sealed against the surroundings and that is connected to the breathing mask so as to deliver thereto breathing gas that leaks from the inner conduit, wherein an end of the passageway distal from the breathing mask is connected to the breathing gas source at a point downstream of the pressure regulator; and an adjustable throttle that the end of the passageway distal from the breathing mask coacts with.

15. Breathing equipment for use in toxic atmospheres or beneath water, comprising:

a breathing mask;

a pressure regulator adjacent the source of breathing gas, the pressure regulator including a spring-biased plunger;

a source of breathing gas; and conduit means for transporting breathing gas from the source of breathing gas to the mask, the conduit means including an inner conduit that functions to transport breathing gas to the breathing mask from the pressure regulator, and an outer conduit that surrounds the inner conduit and that protects the inner conduit and defines therewith a passageway that is sealed against the surroundings and that is connected to the breathing mask so as to deliver thereto breathing gas that leaks from the inner conduit, wherein a space defined by the breathing mask is ventilated to the passageway on a side of the spring-biased plunger that lies opposite to a side that the inner conduit is connected to.

* * * * *